United States Patent [19]

Sawada

[11] Patent Number: 4,592,445

[45] Date of Patent: Jun. 3, 1986

[54] SUCTION DEVICE FOR CHAIN SAW

[75] Inventor: Toshiharu Sawada, Fuchu, Japan

[73] Assignee: Komatsu Zenoah Co., Japan

[21] Appl. No.: 775,834

[22] Filed: Sep. 13, 1985

[30] Foreign Application Priority Data

Sep. 26, 1984 [JP] Japan ..... 59-144271[U]

[51] Int. Cl.[4] ..... F02M 35/12

[52] U.S. Cl. ..... 181/229; 181/240

[58] Field of Search ..... 181/229, 240, 262; 30/381–383

[56] References Cited

U.S. PATENT DOCUMENTS

| | | | |
|---|---|---|---|
| 3,525,373 | 8/1970 | Xobayashi | 30/381 |
| 3,542,095 | 11/1970 | Frederickson et al. | 30/381 |
| 3,994,067 | 11/1976 | Hazzard et al. | 30/383 |
| 4,136,756 | 1/1979 | Kawamura | 181/229 |
| 4,254,746 | 3/1981 | Chiba et al. | 181/229 X |
| 4,261,302 | 4/1981 | Sheldon | 123/141.7 |
| 4,286,675 | 9/1981 | Tuggle | 173/163 |
| 4,302,880 | 12/1981 | Elfving et al. | 30/382 |
| 4,450,933 | 5/1984 | Fukuoka et al. | 181/229 |

*Primary Examiner*—Benjamin R. Fuller

*Attorney, Agent, or Firm*—Wigman & Cohen

[57] ABSTRACT

There is provided a suction device for a chain saw, comprising a suction chamber communicating with a suction port of a carburetor for an engine accommodated within the chain saw, and a muffling path formed within a rear handle of the chain saw to pass through said rear handle and provide communication between the suction chamber and atmosphere so that the suction noise of said engine is prevented from propagating outside due to the interference with the internal wall of said muffling path without providing separately for the chain saw a suction muffler or an air cleaner having a suction muffling path.

4 Claims, 2 Drawing Figures

SUCTION DEVICE FOR CHAIN SAW

BACKGROUND OF THE INVENTION

1. Field of the Invention

The present invention relates to a suction device for a chain saw for sucking air in a suction port of a carburetor of an engine of the chain saw.

2. Description of the Prior Art

In an engine for a conventional chain saw, a suction chamber for accommodating a carburetor is partitioned with a filter element, and the carburetor communicates directly with atmosphere via the filter element. Since the chain saw is generally required to be made as compact as possible to provide convenient handling, it is impossible to provide for the chain saw a separate air cleaner having an elongated suction muffling path, or a separate suction muffler having a suction muffling path. As a result, the sound of suction air of the engine causes a noise which is undesirable for the health of an operator of the chain saw and is feared to cause noise pollution.

SUMMARY OF THE INVENTION

An object of the present invention is to provide a suction device for a chain saw, which is so constituted as to prevent the suction sound of the engine from propagating directly to the atmosphere.

Another object of the present invention is to provide a suction device for a chain saw, which is simple in construction.

A further object of the present invention is to provide a suction device for a chain saw, which is compact and can be accommodated within the chain saw so that a separate suction muffler or a separate air cleaner with a suction muffling path is not needed for the chain saw.

In order to accomplish the objects and advantages mentioned in the above, there is provided according to the present invention a suction device for a chain saw, comprising a suction chamber communicating with a suction port of a carburetor, and a muffling path formed within a rear handle of the chain saw to pass through said handle and provide communication between the suction chamber and atmosphere so that suction noise is prevented from propagating outside by said compact and simple construction without providing separately a suction muffler or an air cleaner having a suction muffling path.

DETAILED DESCRIPTION OF THE EMBODIMENT

Figure 1:
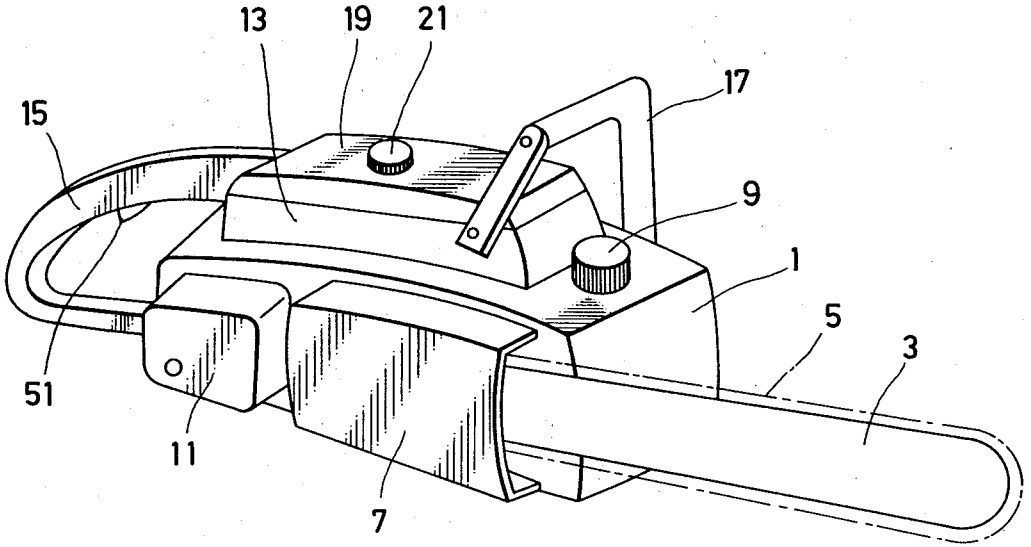
FIG. 1 is a perspective view showing a chain saw provided with a device according to the present invention.
Figure 2:
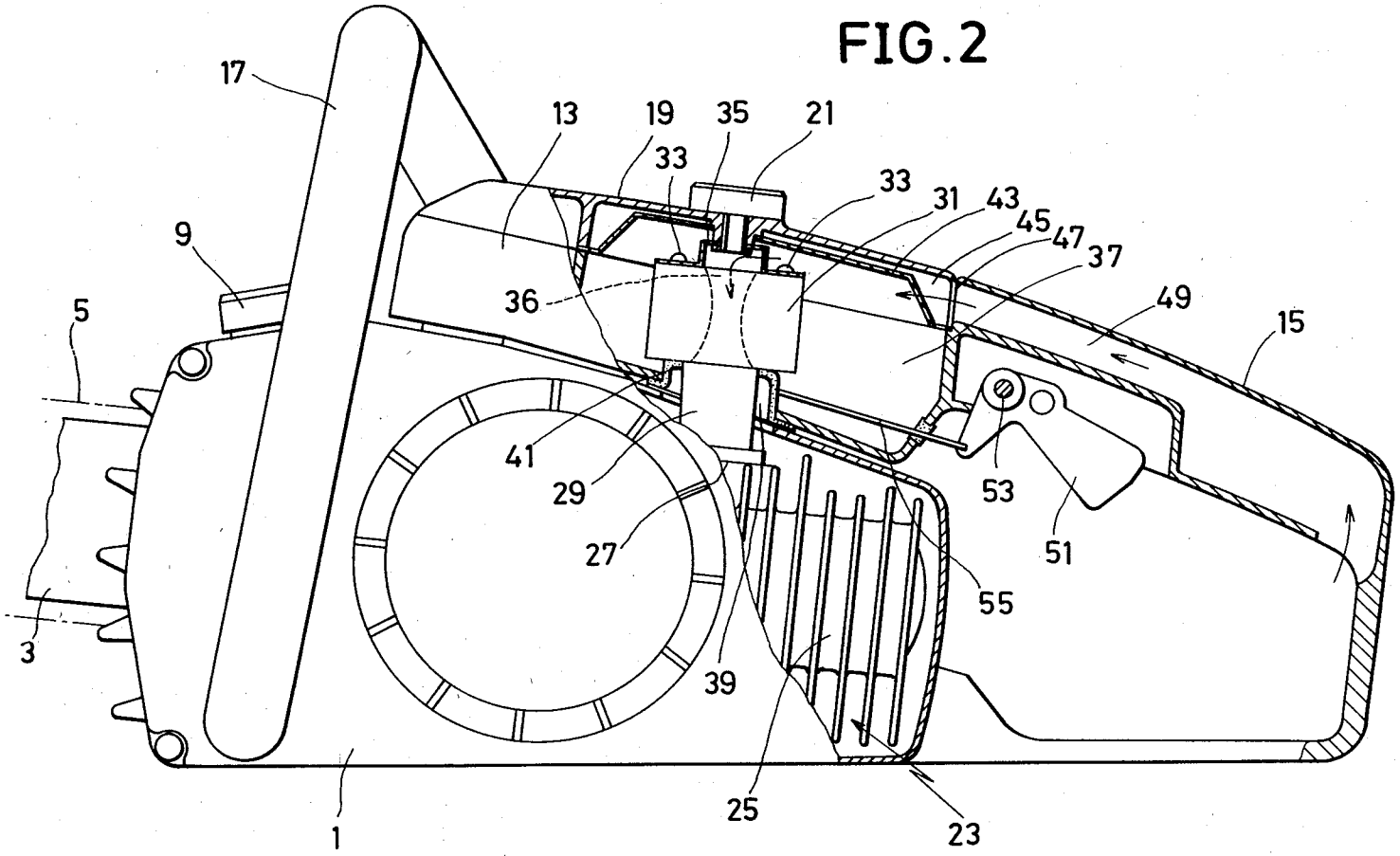
FIG. 2 is a cross sectional side view showing an embodiment according to the present invention.

The details of the present invention are now described with reference to accompanied figures. In the figures, a forwardly projecting guide bar 3 is fixed to one side of a body casing 1. A saw chain 5 is coupled freely slidable around the periphery of the guide bar 3. A side cover 7 is fixed to the body casing 1 to cover the base portions of the guide bar 3 and the saw chain 5. An opening (not shown) for pouring fuel into a fuel tank is provided at front upper part of the body casing 1, said opening being generally closed with a cap 9. A muffler 11 is arranged on one side of the body casing 1.

A supporting body 13 of a box-like shape is attached to the upper surface of the body casing 1 through a vibration isolator (not shown) made of rubber, etc. One end of a rear handle 15 and one end of a front handle 17 are fixed to the supporting body 13, and the other ends of the rear and front handles are supported by the body casing 1 via vibration isolators (not shown) made of rubber, etc. A cover 19 is fixed removably to the upper part of the supporting body 13 with a screw handle 21.

An engine 23 is accommodated within the body casing 1. A carburetor 31 is fixed to an intake opening 27 of a cylinder 25 of the engine 23 through a heat insulator 29. A bracket 35 is fixed to the upper surface of the carburetor 31 by means of screws 33. The threaded portion of the screw handle 21 is screwed into the bracket 35 to fix the cover 19 thereto. The bracket 35 is formed by bending a band shape plate. A suction chamber 17 is formed within the supporting body 13 to surround the carburetor 31 and communicate with a suction port 36 of the carburetor 31. A bored portion 39 located at the lower part of the suction chamber 37 to pass the heat insulator 29 is engaged with a seal 41 made of rubber, etc., for sealing said bored portion 39.

The edge of a filter 43 is held between coupling faces of the supporting body 13 and the cover 19. A chamber 45 on the cover 19 side with respect to the filter 43 communicates via a communicating bore 47 made through the cover 19 with a muffling path 49 provided through the rear handle 15 which is formed in one body with the supporting body 13. The other end of the muffling path 49 is open to the atmosphere. A throttle lever 51 is attached to the rear handle 15 with an axis 53, said lever 51 being freely pivotable around the axis 53 and coacting with a throttle device (not shown) of the carburetor 31 through a rod 55.

In operation, an operator grasps the front handle 17 and the rear handle 15 with his hands, starts to drive the engine 23 to rotate the saw chain 5 around the guide bar 3, and cuts a tree, etc., by the rotating saw chain 5. According to the rotation of the engine 23, air is sucked into the chamber 45 through the muffling path 49, drawn into the suction chamber 37 through the filter 43, and sucked into the suction port 36 of the carburetor 31. The suction sound of the engine 23 is muffled by the interference with the internal wall of the elongated muffling path 49.

Due to the constitution mentioned in the above and specified in claims, a suction noise is prevented from propagating outside with a simple and compact device.

Although the suction chamber 37 and the rear handle 15 are formed in one body, the suction chamber 37 can be formed independently of the rear handle 15 and connected to the muffling path 49 provided within the rear handle 15 by means of a flexible pipe.

It shall be understood that the present invention is not limited to the embodiment mentioned in the above, and many modifications may be made according to the present invention.

What is claimed is:

1. A suction device for a chain saw, comprising:

a suction chamber communicating with a suction port of a carburetor for an engine accommodated within the chain saw, said suction chamber being formed to surround said carburetor;

a muffling path formed within a rear handle of the chain saw to pass through said rear handle and provide communication between the suction chamber and atmosphere;

an air filter located between said suction chamber and said muffling path; and a chamber formed adjacent to said air filter on the side of said muffling path, wherein, according to the rotation of said engine, air is sucked from atmosphere into said chamber through said muffling path, drawn into said suction chamber through said air filter, and sucked into said suction port of said carburetor so that the suction noise of said engine is prevented from propagating outside due to the interference with the internal wall of said muffling path without providing separately for the chain saw a suction muffler or an air cleaner having a suction muffling path.

2. A suction device for a chain saw according to claim 1, wherein said suction chamber and said rear handle are formed in one body.

3. A suction device for a chain saw according to claim 1, wherein said suction chamber is formed independently of said rear handle and connected with the muffling path provided within said rear handle with a connecting means.

4. A suction device for a chain saw according to claim 3, wherein said connecting means comprises a flexible pipe.

* * * * *